United States Patent [19]

Braun et al.

[11] Patent Number: 4,776,639

[45] Date of Patent: Oct. 11, 1988

[54] TOOL ASSEMBLY FOR MINING MACHINES, COAL PLANES AND COAL CUTTING MACHINES

[75] Inventors: Gert Braun; Ernst Braun, both of Essen-Heisingen, Fed. Rep. of Germany

[73] Assignee: Halbach & Braun Industrieanlagen, Fed. Rep. of Germany

[21] Appl. No.: 129,988

[22] Filed: Dec. 8, 1987

[30] Foreign Application Priority Data

Dec. 10, 1986 [DE] Fed. Rep. of Germany ... 8633094[U]

[51] Int. Cl.[4] ..... E21B 10/62; E21C 27/44

[52] U.S. Cl. ..... 299/91; 175/413; 403/378; 407/47; 407/102

[58] Field of Search ..... 299/79, 91-93, 299/34; 175/413; 37/142 R; 407/47, 48, 102, 103; 403/6, 378, 379, 325

[56] References Cited

U.S. PATENT DOCUMENTS

| | | | |
|---|---|---|---|
| 3,904,247 | 9/1975 | Ostrop | 299/91 |
| 4,609,227 | 9/1986 | Wild et al. | 299/93 |

FOREIGN PATENT DOCUMENTS

| | | | |
|---|---|---|---|
| 1291708 | 4/1969 | Fed. Rep. of Germany | 299/91 |
| 958933 | 5/1964 | United Kingdom | 299/91 |

*Primary Examiner*—Jerome Massie
*Assistant Examiner*—David J. Bagnell
*Attorney, Agent, or Firm*—McGlew and Tuttle

[57] ABSTRACT

A tool assembly for mining machines and particularly for coal planes or coal cutting machines comprises a cutter which has a shank portion which is engaged to a seat of a size comparable to the shank portion of a cutter holder and it is held in that position by a locking pin which extends through aligned bores of the holder and the shank portion which may be retracted into a knock-out slot defined in the shank portion which is closed on each side by a portion of the cutter holder in an arrangement in which the locking pin may be retracted into the knockout slot for removal of the cutter.

2 Claims, 1 Drawing Sheet

TOOL ASSEMBLY FOR MINING MACHINES, COAL PLANES AND COAL CUTTING MACHINES

FIELD AND BACKGROUND OF THE INVENTION

This invention relates in general to mining equipment and in particular to a new and useful tool assembly for mining machines which includes a cutter having a shank portion engaged in a holder which is lockable in position by a locking pin and which can be removed by retracting the locking pin into a knockout slot of the cutter shank.

The invention particularly concerns a tool assembly for mining machines, particularly coal planes or coal cutting machines, comprising a cutter with a shank and a cutter holder with shank seat, whereby the cutter shank is secured in the seat by means of a locking pin, which engages in transverse bores in the cutter holder and the cutter shank.

Such tool assemblies are known, whereby the transverse bores to receive the locking pin penetrate the entire cutter holder and cutter shank. When loosening the cutter, for example, during tool change or repairs, the locking pin must be knocked out of the aligned transverse bores, and is rather easily lost, since otherwise it would have to be caught on the side away from the blow. This is troublesome. The purpose of the invention is to alleviate this situation.

SUMMARY OF THE INVENTION

The goal of the invention is to create a tool assembly for mining machines, particularly coal planes or coal cutting machines in which the locking pin cannot be lost in the process of loosening the connection between the cutter shank and the cutter holder.

The invention provides a cutter holder with a receiving seat having a transverse bore for a locking pin which aligns with a transverse bore of the cutter shank, and the bore of the cutter shank is adjusted by a knockout slot for the locking pin in the cutter shaft, extending orthogonally to the transverse bore, and the knockout slot emerges onto the surface of the shank on at least one side. As a result of these measures, the locking pin (which can also be an adapter sleeve within the context of the invention) is driven only into the knockout slot when loosening the connection between the cutter holder and the cutter shank. As long as the cutter shank remains in the cutter holder or in the shank seat, the locking pin remains in the knockout slot, whose width and height are chosen to be equal to or somewhat larger than the length and diameter of the locking pin. Only when the cutter shank is removed from the shank seat can the locking pin be easily extracted, as it then drops out or is driven out sideways from the lockout slot. The knockout slot can penetrate the entire cutter shank, that is, emerge onto the shank surface at both ends, so that the transverse bore and the knockout slot form a practically T-shaped recess in the cutter shank. On the whole, the loosening of the connection between cutter shank and cutter holder is facilitated, without losing the locking pin. This constitutes the main advantages of the invention.

Accordingly, it is an object of the invention to provide a tool assembly for mining machine tools which includes a cutter having a shank portion engaged in a seat formed in a cutter holder which is held in position in the shank portion by a locking pin which moves in aligned bores of the holder and the shank portion and may be retracted into a knockout slot defined in the cutter shank.

A further object of the invention is to provide a tool assembly for mining machines which is simple in design, rugged in construction and economical to manufacture.

The various features of novelty which characterize the invention are pointed out with particularity in the claims annexed to and forming a part of the disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
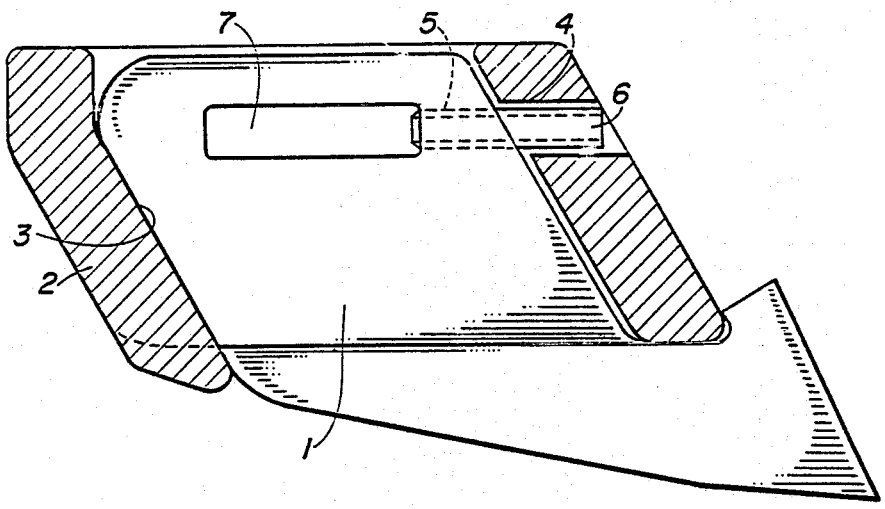
FIG. 1 is a sectional view partly in elevation of a segment of a tool assembly constructed in accordance with the invention.
Figure 2:
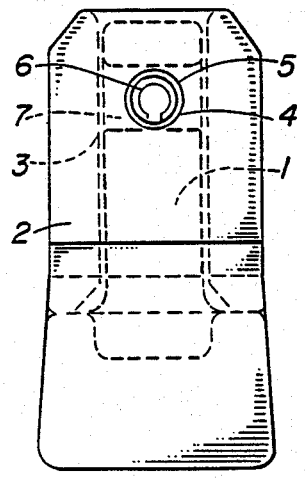
FIG. 2 shows a front view of the tool assembly of FIG. 1.

Referring to the drawings in particular, the invention embodied therein comprises a tool assembly for mining machines, particularly coal planes or coal cutting machines and which includes a cutter shank 1 which is engaged in a recess or shank seat 3 of a cutter holder 2 and is locked in this position by means of locking pin 6 which extends to a transverse hole 4 of the holder 2 which aligns with a transverse bore 5 of cutter shank portion 1.

The FIGS. show a tool assembly for mining machines, particularly coal planes or coal cutting machines which in its basic layout comprises a cutter with cutter shank 1 and a cutter holder 2 with shank seat or receiving recess 3. The cutter shank 1 is secured in the shank seat 3 by means of a locking pin 6, which engages in aligned transverse bores 4, 5 of the cutter holder 2 and the cutter shank 1. This may also apply to an adapter sleeve (not shown) arranged between the two parts. The transverse bore 5 of the cutter shank 1 adjoins a knockout slot 7 for the locking pin 6 in the cutter shank 1, which extends orthogonally to the transverse bore 5, whereby the knockout slot 7 emerges onto the shank surface on at least one end. Preferably, the knockout slot 7 penetrates the entire cutter shank 1, and therefore emerges onto a shank surface at each side of the sleeve 1 and is closed off here by the cutter holder 2 in the manner of a casing. To loosen the connection between the cutter shank 1 and the cutter holder 2, the locking pin 6 need only be driven into the knockout slot 7, whose width and height are choosen to be equal to or larger than the length and diameter of the locking pin 6, so that the locking pin 6 after removal of the cutter shank 1 from the cutter holder 2 can be easily extracted, since it will fall out of the knockout slot 7 at either side.

While a specific embodiment of the invention has been shown and described in detail to illustrate the application of the principles of the invention, it will be understood that the invention may be embodied otherwise without departing from such principles.

What is claimed is:

1. A tool assembly for mining machines, particularly coal planes and coal cutting machines, comprising a cutter having a shank, a cutter holder having a shank seat with an opening into which said cutter shank extends, said cutter shank and said holder each having a transverse bore which are alignable when said cutter shank is in said cutter holder seat, said cutter shank having a knockout slot alignable with said tranverse bore of said shank and including a locking pin movable in said cutter shank transverse bore and into said holder transverse bore to lock said cutter shank to said holder, said cutter shank having a knockout slot alignable with said transverse bore in position to receive said locking pin to permit the locking pin to be withdrawn from said transverse bore of said holder, said holder closing said knockout slot and said locking pin when said cutter shank is engaged in said shank seat of said cutter holder.

2. A tool assembly according to claim 1, wherein said knockout slot opens into each side of said cutter shank, said locking pin being withdrawable into said knockout slot and being removable when said cutter shank is withdrawn from said shank seat.

* * * * *